US010092053B2

(12) United States Patent
Peterson

(10) Patent No.: US 10,092,053 B2
(45) Date of Patent: Oct. 9, 2018

(54) SUBLIMATION PRINTED CLOTHING ARTICLES

(71) Applicant: AMERICAN MILLS INTL. L.L.C., Minneapolis, MN (US)

(72) Inventor: Brad Peterson, Minneapolis, MN (US)

(73) Assignee: CREEDENCE HOLDINGS LLC, Alameda, CA (US)

( * ) Notice: Subject to any disclaimer, the term of this patent is extended or adjusted under 35 U.S.C. 154(b) by 357 days.

(21) Appl. No.: 14/970,138

(22) Filed: Dec. 15, 2015

(65) Prior Publication Data

US 2016/0165990 A1 Jun. 16, 2016

Related U.S. Application Data

(60) Provisional application No. 62/092,082, filed on Dec. 15, 2014, provisional application No. 62/103,456, filed on Jan. 14, 2015.

(51) Int. Cl.
*A42B 1/00* (2006.01)
*A41D 27/08* (2006.01)
(Continued)

(52) U.S. Cl.
CPC ..... *A42B 1/004* (2013.01); *A41D 27/08* (2013.01); *D03D 1/0041* (2013.01); *D04B 1/24* (2013.01);
(Continued)

(58) Field of Classification Search
CPC ..... B41M 2205/02; A42B 1/00; A42B 1/04; A41D 27/08; D03D 1/0041; D04B 1/24;
(Continued)

(56) References Cited

U.S. PATENT DOCUMENTS 4,273,817 A 6/1981 Matsuo et al.
6,502,245 B1 * 1/2003 McBride ..... A42B 1/22 2/181
(Continued)

FOREIGN PATENT DOCUMENTS

CA 2578556 A1 8/2007
CN 1177969 C 12/2004
(Continued)

OTHER PUBLICATIONS

Wizbang, Microfleeced Lined Hat, website: https://www.wizbanghats.com/product/microfleeced-lined-hat/, retrieved on Jun. 24, 2016, 7 pages.
(Continued)

*Primary Examiner* — Bruce H Hess
(74) *Attorney, Agent, or Firm* — John C Merchant

(57) ABSTRACT

An article of clothing may include a first layer made of a polyester fabric. The polyester fabric may have the following properties a thread count of at least 130 threads per square inch, a weft knit weave pattern, and a bird's eye mesh texture. The polyester fabric may include a dye sublimation printed image with a resolution that is at least 200 dots per inch. The dye sublimation printed image may be oriented to stretch laterally with a lateral stretch of the polyester. The article of clothing may also include a second layer attached to the first layer. The second layer may include a lining fabric configured to stretch laterally with the first layer.

16 Claims, 15 Drawing Sheets

(51) Int. Cl.
*D03D 1/00* (2006.01)
*D04B 1/24* (2006.01)

(52) U.S. Cl.
CPC ... *B41M 2205/02* (2013.01); *D10B 2501/041* (2013.01); *D10B 2501/042* (2013.01); *D10B 2501/043* (2013.01)

(58) Field of Classification Search
CPC ..... D10B 2501/00; D10B 2501/04; D10B 2501/041; D10B 2501/042; D10B 2501/043
USPC ..... 503/227
See application file for complete search history.

(56) References Cited

U.S. PATENT DOCUMENTS

| | | | | |
|---|---|---|---|---|
| 6,571,396 | B1 * | 6/2003 | Yan | A41D 19/00 2/195.1 |
| 2007/0163057 | A1 | 7/2007 | Bertele et al. | |
| 2008/0155732 | A1 | 7/2008 | Vassell | |
| 2009/0034012 | A1 | 2/2009 | Northup et al. | |
| 2009/0119818 | A1 | 5/2009 | Ngo et al. | |
| 2009/0280290 | A1 | 11/2009 | Weedlun | |
| 2010/0178445 | A1 | 7/2010 | Shen et al. | |
| 2010/0212059 | A1 | 8/2010 | Morrison | |
| 2011/0086208 | A1 | 4/2011 | Nemphos, Jr. et al. | |
| 2012/0132355 | A1 | 5/2012 | Turner | |
| 2013/0022795 | A1 | 1/2013 | Wang et al. | |
| 2014/0212635 | A1 | 7/2014 | Ngo | |
| 2015/0064372 | A1 | 3/2015 | Dinescu et al. | |
| 2015/0140275 | A1 | 5/2015 | Abrams | |

FOREIGN PATENT DOCUMENTS

| | | | |
|---|---|---|---|
| CN | 101538798 | A | 9/2009 |
| CN | 103610236 | A | 3/2014 |
| FR | 2139776 | A1 | 1/1973 |
| GB | 2338210 | A | 12/1999 |
| JP | 2003328283 | A | 11/2003 |
| JP | 2011219903 | A | 11/2011 |
| KR | 100581607 | B1 | 5/2006 |
| KR | 101032226 | B1 | 5/2011 |
| KR | 101039821 | B1 | 6/2011 |
| KR | 20140069809 | A | 6/2014 |
| WO | 2011/011177 | A1 | 1/2011 |

OTHER PUBLICATIONS

Art of Where, Fabrics & Printing, website: https://web.archive.org/web/20140625054124/http://artofwhere.com/page/fabric-printing-108, Jun. 24, 2016, 5 pages.
Wizbang, Fleece Lined Hat, website: https://web.archive.org/web/20140927134224/http://www.wizbanghats.com/products/hat-fleece-lined, Jun. 24, 2016, 2 pages.

* cited by examiner

SUBLIMATION PRINTED CLOTHING ARTICLES

FIELD

Some embodiments described in the present disclosure generally relate to articles of clothing with sublimation printings.

BRIEF SUMMARY OF SOME EXAMPLE EMBODIMENTS

According to an aspect of an embodiment, an article of clothing may include a first layer made of a polyester fabric. The polyester fabric may have the following properties a thread count of at least 130 threads per square inch, a weft knit weave pattern, and a bird's eye mesh texture. The polyester fabric may include a dye sublimation printed image with a resolution that is at least 200 dots per inch. The dye sublimation printed image may be oriented to stretch laterally with a lateral stretch of the polyester. The article of clothing may also include a second layer attached to the first layer. The second layer may include a lining fabric configured to stretch laterally with the first layer.

The object and advantages of the embodiments will be realized and achieved at least by the elements, features, and combinations particularly pointed out in the claims. It is to be understood that both the foregoing general description and the following detailed description are exemplary and explanatory and are not restrictive of the invention, as claimed.

BRIEF DESCRIPTION OF THE DRAWINGS

Example embodiments will be described and explained with additional specificity and detail through the use of the accompanying drawings in which.

DETAILED DESCRIPTION OF SOME EXAMPLE EMBODIMENTS

Figure 1A:
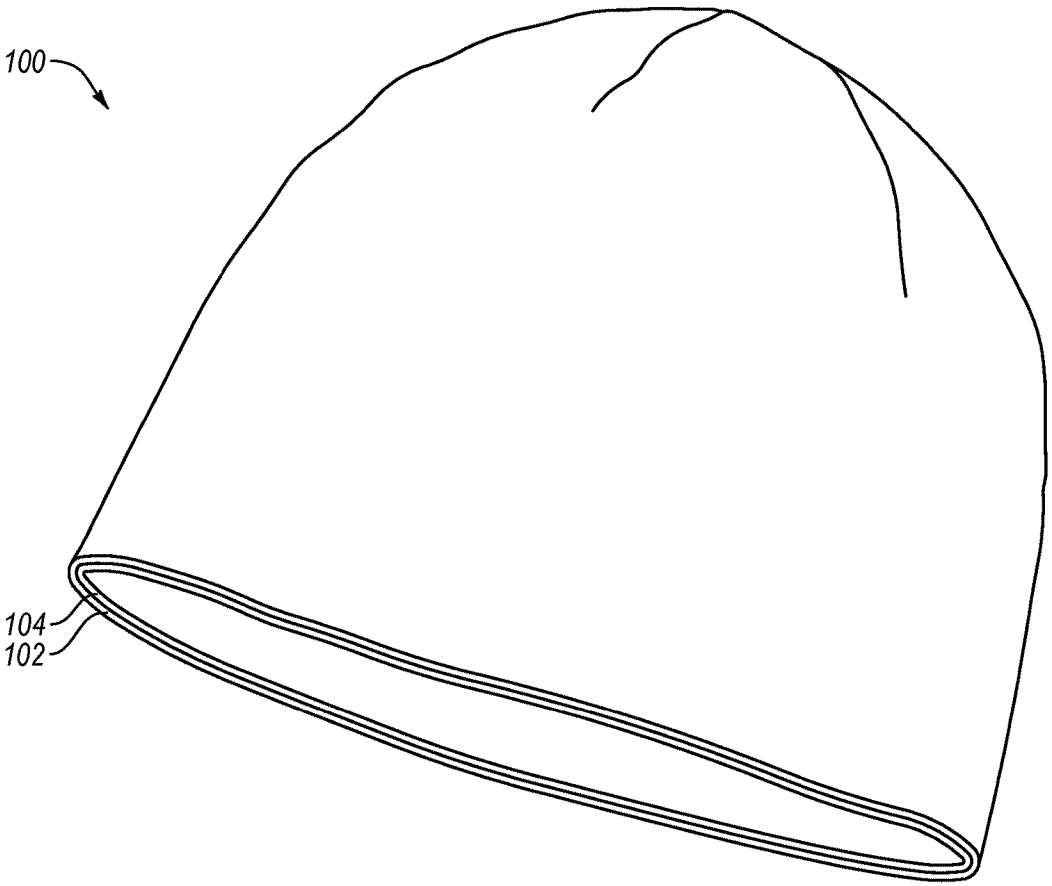
FIG. 1A illustrates an example headwear article.

Embodiments described in the present disclosure generally relate to sublimation printed articles of clothing. Some embodiments may include sublimation printed headwear articles, sublimation printed scarves, sublimation printed socks, sublimation printed gloves, sublimation printed neck warmers, sublimation printed balaclavas, etc.

In some embodiments, an article of clothing may include at least two layers, a first layer and a second layer. The first layer may be configured as an outer layer and the second layer may be configured as an inner layer in some embodiments. Additionally or alternatively, the first layer may be made of a first fabric that includes a polyester fabric that may be capable of accepting a dye sublimation printing through a dye sublimation heat transfer imprinting process (referred to hereinafter as "sublimation printing"). The polyester fabric may include 100% polyester or a polyester blend. For example, the polyester fabric may include poly acrylic, polyester lycra, polyester cotton, polyester wool blends, and/or any other suitable material.

In addition, the polyester fabric may include properties that may allow for relatively high resolution (e.g., between 100 and 1500 dots per inch (DPI)) sublimation printing on the polyester fabric. For example, the polyester fabric may have a particular weave pattern, thread count, texture, stretchability, thread size, etc. that may allow for a higher resolution print than other materials with which sublimation printing may be used.

In some embodiments, the second layer may include a second fabric that may not allow for high resolution sublimation printing, but that may provide more insulation than the first layer. For example, the second fabric may include any fabric that may be used for cold weather insulation such as a knit fabric, a thermal knit fabric, a polar fleece fabric, a microfiber fabric, etc.

In some embodiments, the first fabric and the second fabric may be stretchable. In these and other embodiments, the first fabric may be less stretchable than the second fabric. For example, the second fabric may be capable of stretching by up to 300%, or another suitable percentage compared to an unstretched status of the second fabric. In contrast, the first fabric may be capable of stretching by no more than 50% in some embodiments. In the present disclosure, reference to stretchability of a fabric may refer to how much the fabric may stretch before damaging the fabric such that it may lose some stretchability.

The second layer may be attached to the first layer such that the second layer may be an inner layer of the article of clothing and such that the first layer may be an outer layer of the article of clothing. In some embodiments, (e.g., when the second fabric is more stretchable than the first fabric) the first layer may be sized bigger than the second layer to allow the second layer to stretch more than the first layer while not being substantially restricted by the reduced stretchability of the first fabric.

Reference will now be made to the drawings to describe various aspects of some example embodiments of the present disclosure. The drawings are diagrammatic and schematic representations of such example embodiments, and are not limiting of the present disclosure, nor are they necessarily drawn to scale.

FIG. 1A illustrates an example headwear article 100, arranged in accordance with at least some embodiments described in the present disclosure. Examples of the headwear article 100 may include, but are not limited to, a beanie, a hat, an athletic headwear item, and any other types of headwear items. In some embodiments, the headwear article 100 may be a headwear item used in cold weather for keeping warm. Although description in the disclosure refers to a headwear article, more generally the description may also be applicable to any articles that may be worn or carried by users. The headwear article 100 may include one or more layers that may be combined together to form the headwear article 100. For example, the headwear article 100 may include a first layer 102 and a second layer 104 as illustrated in FIG. 1. In these and other embodiments, the headwear article 100 may include one or more additional layers disposed between the first layer 102 and the second layer 104. In some embodiments, the first layer 102 and/or the second layer 104 may be stretchable, in which the second layer 104 may be more stretchable than the first layer 102.

Figure 9:
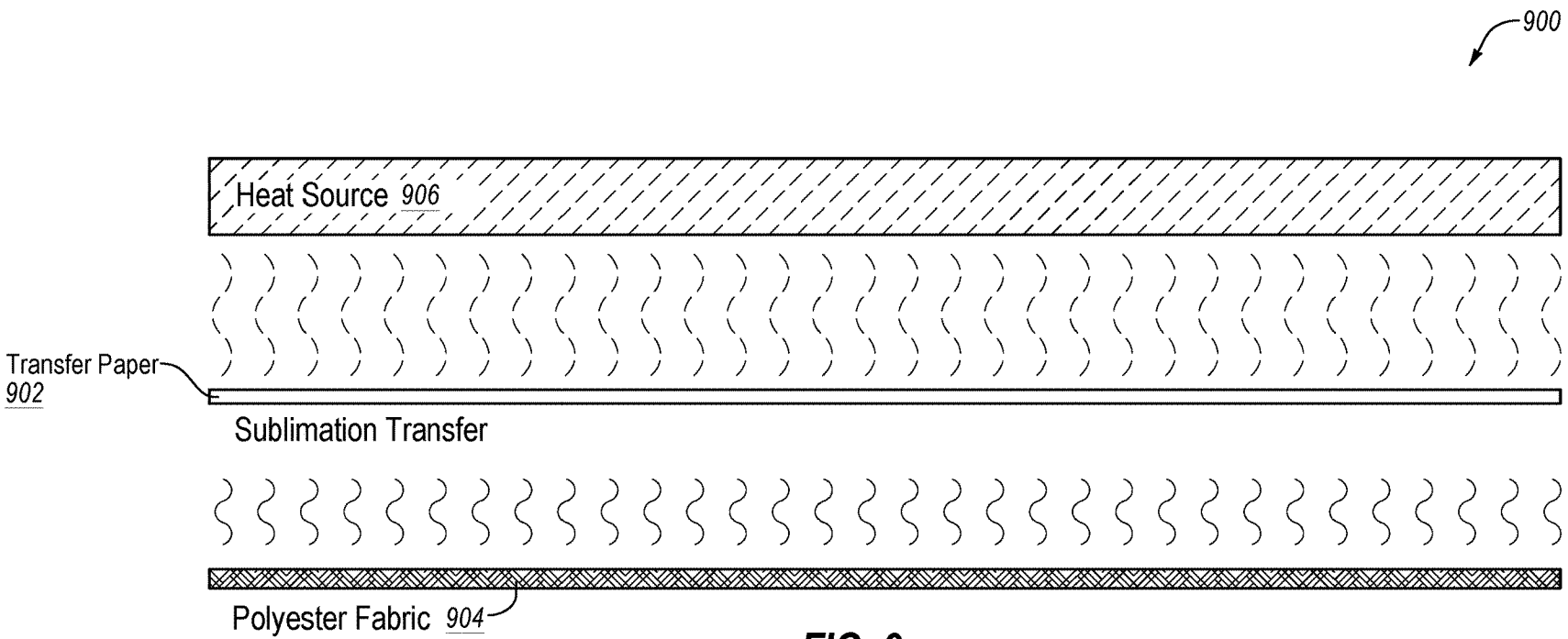
FIG. 9 is a graphic representation that illustrates an example dye sublimation heat transfer printing process.

The first layer 102 may be made of a first fabric that may be a polyester fabric capable of accepting dye sublimation printing. An image may be printed on the first layer 102 through sublimation printing, as illustrated in FIG. 9. In some embodiments, the polyester fabric of the first layer 102 may include 100% polyester, which may be well suited for sublimation printing. Alternatively, the polyester fabric may include a polyester blend. For example, the polyester fabric may include jersey mesh, knit, thermal knit, polar fleece, microfiber, stretchable woven, any other polyester material, and/or some combination thereof.

As mentioned above, the polyester fabric may include properties that may allow for relatively high resolution (e.g., between 100 and 1500 dots per inch (DPI)) sublimation printing on the polyester fabric. For example, the polyester fabric may be 100% polyester and may have a particular weave pattern, thread count, texture, stretchability, thread size, etc. that may allow for a higher resolution print than other materials with which sublimation printing may be used. By way of example, the gases used for sublimation printing may be able to penetrate polyester better than other materials and the better penetration may result in being able to obtain a higher resolution. As such, a high polyester percentage may allow for a higher resolution than a low polyester percentage. Further, a relatively high thread count may allow for a higher resolution than a relatively low thread count. In addition, a particular weave pattern that is relatively tight may allow for a higher resolution than a looser thread count. Moreover, a relatively smooth texture may allow for a higher resolution than a less smooth texture. In addition, thread size may affect the thread count or the tightness of the weave such that thread size may also affect the resolution. Further, a relatively high stretchability may cause the polyester fabric to move during the printing process or may require a degree of stretching of the polyester fabric during the printing process, which may result in a reduced ability to achieve a high resolution.

An example of the polyester fabric that may be well suited for high resolution sublimation printing may be that the polyester fabric may be 100% polyester and have a thread count of at least 130 threads per square inch (e.g, 65D×65F). Further, the polyester fabric may have a weft knit weave pattern and a bird's eye mesh texture. In some embodiments, the polyester fabric may have a stretchability that may endure no more than 50% lateral stretch, or another suitable percentage of lateral stretch relative to an unstretched status of the polyester fabric.

The second layer 104 may be attached to the first layer 102. For example, the second layer 104 may be sewn to, glued to, or compressed with the first layer 102. The second layer 104 may be made of a second fabric that may be a lining fabric that may be capable of stretching laterally. The lining fabric in the second layer 104 may include acrylic knit, cotton knit, wool knit, polar fleece, polyester stretchable fabric, any other stretchable fabric, and/or some combination thereof. In some embodiments, the lining fabric may have a stretchability that may endure at least up to 300% of stretch, or another suitable percentage of lateral stretch relative to an unstretched status of the lining fabric. In these or other embodiments, the lining fabric may not allow for high resolution sublimation printing as compared to the polyester fabric of the first fabric, but may provide more insulation than the first fabric. For example, the lining fabric may include any fabric that may be used for cold weather insulation such as a knit fabric, a thermal knit fabric, a polar fleece fabric, a microfiber fabric, etc.

In some embodiments, the first layer 102 may be constructed as an outer shell or an outer layer of the headwear article 100, and the second layer 104 may be constructed as an inner shell or an inner layer of the headwear article 100. The outer shell (e.g., the first layer 102) of the headwear article 100 may be printed with an image through sublimation printing. Alternatively or additionally, the first layer 102 may be constructed as an inner shell or an inner layer of the headwear article 100, and the second layer 104 may be constructed as an outer shell or an outer layer of the headwear article 100. The inner shell (e.g., the first layer 102) of the headwear article 100 may be printed with an image through sublimation printing.

Alternatively or additionally, the second layer 104 may include the same or similar polyester fabric as the first layer 102 so that both of the first layer 102 and the second layer 104 may be printed with images through sublimation printing. For example, a first image may be printed on the first layer 102 through a first process of sublimation printing and a second image may be printed on the second layer 104 through a second process of sublimation printing. The first image and the second image may be the same image or different images such that the headwear article 100 may have interchangeable images depending on whether the first layer 102 is on the outside or the second layer 104 is on the outside. In some of these embodiments, a third layer of lining material may be between the first layer 102 and the second layer 104 for extra warmth.

In some embodiments, the headwear article 100 may not be printed with any image during production and may have a blank polyester fabric outer or inner shell. The blank polyester fabric outer or inner shell may be configured to accept sublimation printing in post-production.

In some embodiments, construction of the headwear article 100 with the first layer 102 and the second layer 104 may enable the headwear article 100 to satisfy an elastic attribute. For example, a target configuration of the headwear article 100 may be that the bottom of the headwear article 100 is capable of stretching laterally by between 10% and 50%, or another suitable percentage relative to an unstretched status of the headwear article 100 to allow for fitting on different head sizes.

Additionally, the headwear article 100 may be configured such that its shape may be maintained during the stretching and to help the headwear article 100 conform to the wearer's head. For example, the headwear article 100 may be constructed such that the bottom portion of the headwear article 100 may stretch more than the top portion of the headwear article 100 to help maintain the shape of the headwear article 100 and to help the headwear article 100 conform to a wearer's head. For example, the headwear article 100 may be configured such that the bottom portion may have a stretchability approximately between 30% and 60% and may be configured such that the top portion may have a stretchability approximately between 10% and 30%. In addition, the construction may be based on the elastic properties of the polyester material due to the polyester material having a relatively low amount of stretchability.

An example configuration of the top size may include the headwear article 100 being 15 centimeters (cm) across in an unstretched configuration and being 18 cm across in a stretched configuration along a line approximately ⅓ from the top of the headwear article 100. An example configuration of the bottom size may size may include the headwear article 100 being 21 centimeters (cm) across in an unstretched configuration and being 30 cm across in a stretched configuration at the bottom of the headwear article 100.

Figure 1B:
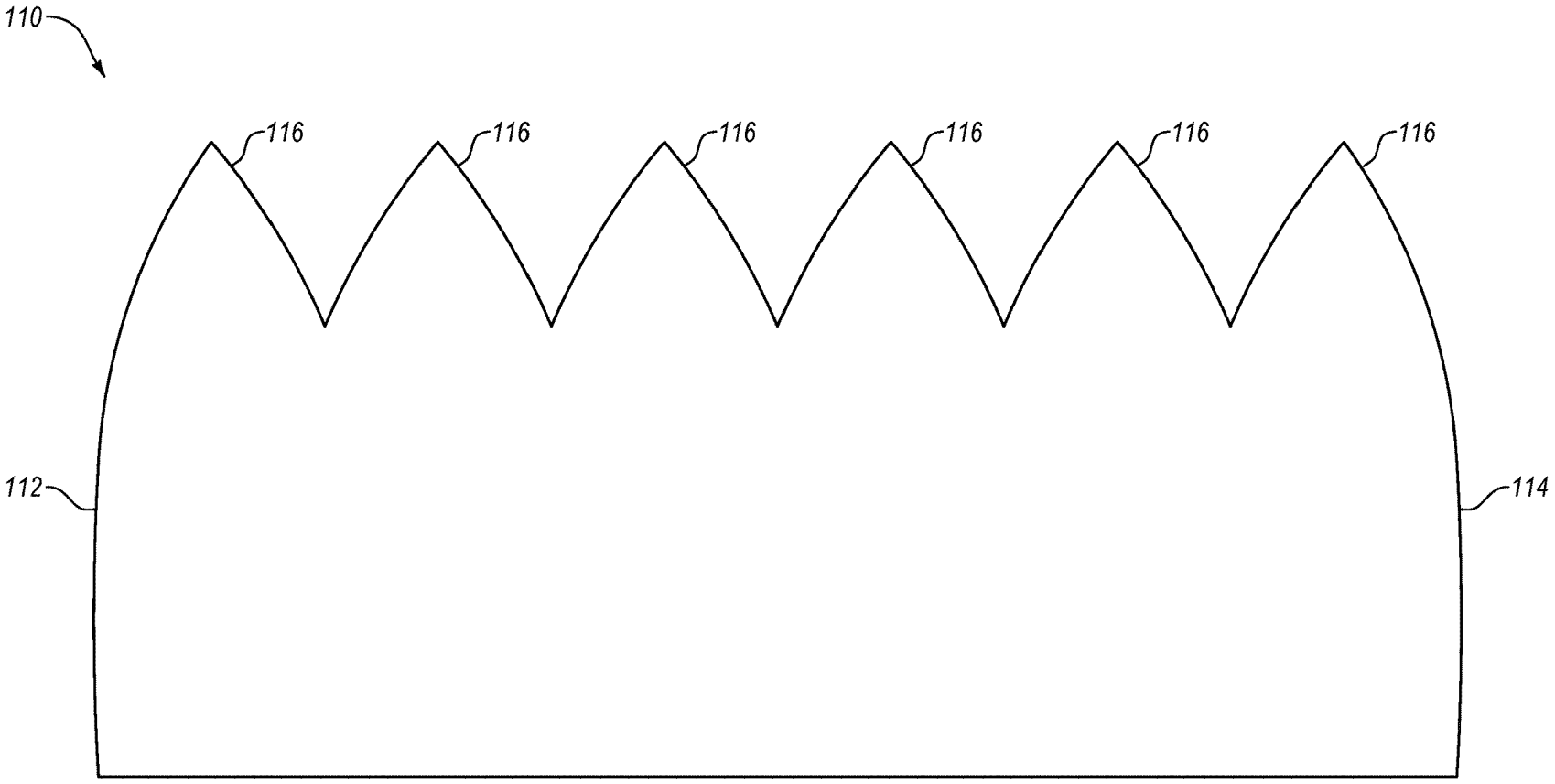
FIG. 1B illustrates an example pattern that may be used for the example headwear article of FIG. 1A.

By way of example, FIG. 1B illustrates an example pattern 110 that may be used for the first layer 102 and/or the second layer 104 for the headwear article 100 of FIG. 1A, according to some embodiments of the present disclosure. The pattern 110 depicts a pattern of the fabric of the first layer 102 or the second layer 104 before the fabric has been put together such that it depicts an example of the first layer 102 or the second layer fabric laying flat. The pattern 110 may include multiple triangular shaped portions 116 that may correspond to the top of the headwear article 100. In the illustrated example, the pattern 110 may include six triangular shaped portions 116, but more or fewer triangular shaped portions may be used. The triangular portions 116 may have a height that may be between ⅓ and ⅙ the total height of the pattern 110. In the illustrated embodiment, the height of the triangular portions 116 may be approximately ¼ the total height of the pattern 110.

Construction of the headwear article 100 with respect to FIG. 1B may include connecting (e.g., sewing) a side 112 of the pattern 110 with an opposite side 114 of the pattern 110. The construction may also include connecting (e.g., sewing) the triangular shaped portions 116 to each other such that the headwear article 100 may be enclosed at the top. The connection of the triangular shaped portions 116 may give the headwear article 100 its shape. Further, the connection of the triangular shaped portions 116 may also pull the top portion of the headwear article 100 that may correspond to the triangular portions 116 together to help the headwear article 100 maintain its shape. Further, the connection of the triangular portions 116 may restrict lateral stretch of the headwear article 100 within the top portion of the headwear article 100 that may correspond to the triangular portions 116. Such restriction on the stretch may also allow for the headwear article 100 to maintain its shape and may also help conform the headwear article 100 to the head of the wearer. The number of triangular portions 116 may vary depending on a target shape and/or stretchability of the headwear article 100.

Returning to FIG. 1A, in some embodiments, the first layer 102 may also be sized to be larger than the second layer 104 to help obtain the target stretchability. For example, in some embodiments, the target stretchability for the bottom portion may be 50% but the polyester fabric of the first layer 102 may have a stretchability of only 40%. In these or other embodiments, the first layer 102 may be sized at least 10% larger than the second layer 104 such that the second layer 104 may be able to stretch approximately 50%. As such, the overall stretchability of the headwear article 100 with respect to being able to fit over a wearer's head may be approximately 50%.

Figure 2A:
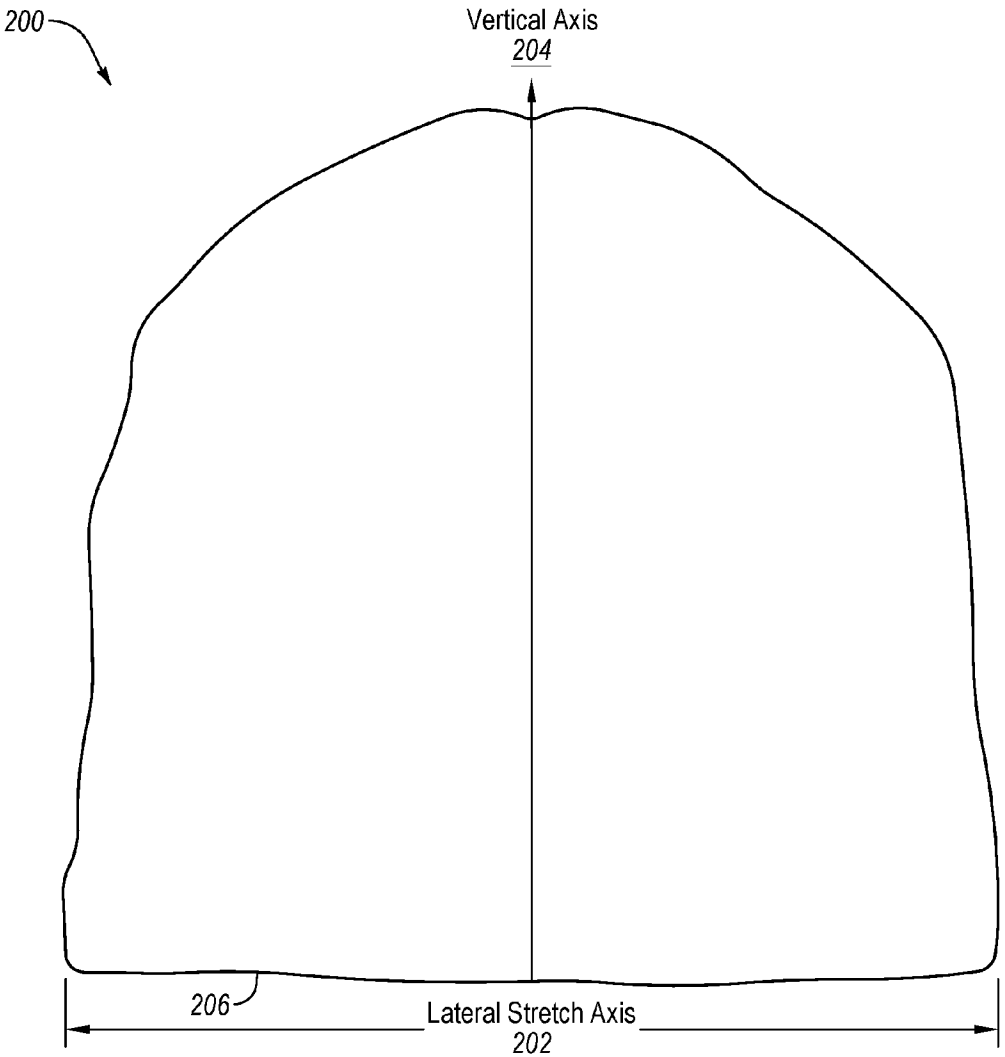
FIG. 2A is a graphic representation that illustrates an example headwear article with a blank fabric panel.

FIG. 2A is a graphic representation that illustrates an example headwear article 200 with a blank fabric panel, arranged in accordance with at least some embodiments described herein. The headwear article 200 may have the same or similar structure as the headwear article 100 of FIG. 1. The blank fabric panel may be part of an inner shell or an outer shell of the headwear article 200. The blank fabric panel may be printed with one or more images through a process sublimation printing.

In some embodiments, a bottom part of the headwear article 200 may include an opening so that a user may put the headwear article 200 on his or her head through the opening. A lateral stretch axis 202 may be referred to as an axis that is in parallel with a bottom edge 206 of the headwear article 200. The headwear article 200 may be configured such that it may be stretched laterally along the lateral stretch axis 202. A vertical axis 204 may be referred to an axis that is aligned with a direction from a top part of the headwear article 200 to the bottom part of the headwear article 200. The vertical axis 204 may be orthogonal to the lateral stretch axis 202. In some embodiments, the headwear article 200 may be symmetric with respect to the vertical axis 204.

As described above with respect to the headwear article 100, construction of the headwear article 200 with a first layer and a second layer may be analogously performed to enable the headwear article 200 to satisfy an elastic attribute such that the headwear article 200 may be capable of stretching laterally by between 10% to 50% at the bottom of the headwear article 200, or another suitable percentage relative to an unstretched status of the headwear article 200. Further, as described above, in some embodiments, a top portion of the headwear article 200 may be configured to stretch less than the bottom portion of the headwear article 200.

In some embodiments, an image printed on the headwear article 200 may be oriented such that a lateral stretch on the headwear article 200 may correspond to a lateral stretch on the image rather than a vertical stretch on the image. For example, a top and a bottom of the image may be printed on the top part and the bottom part of the headwear article 200 respectively so that a lateral stretch of the headwear article 200 may correspondingly cause a lateral stretch of the image and a vertical stretch of the headwear article 200 may correspondingly cause a vertical stretch of the image.

Figure 2B:
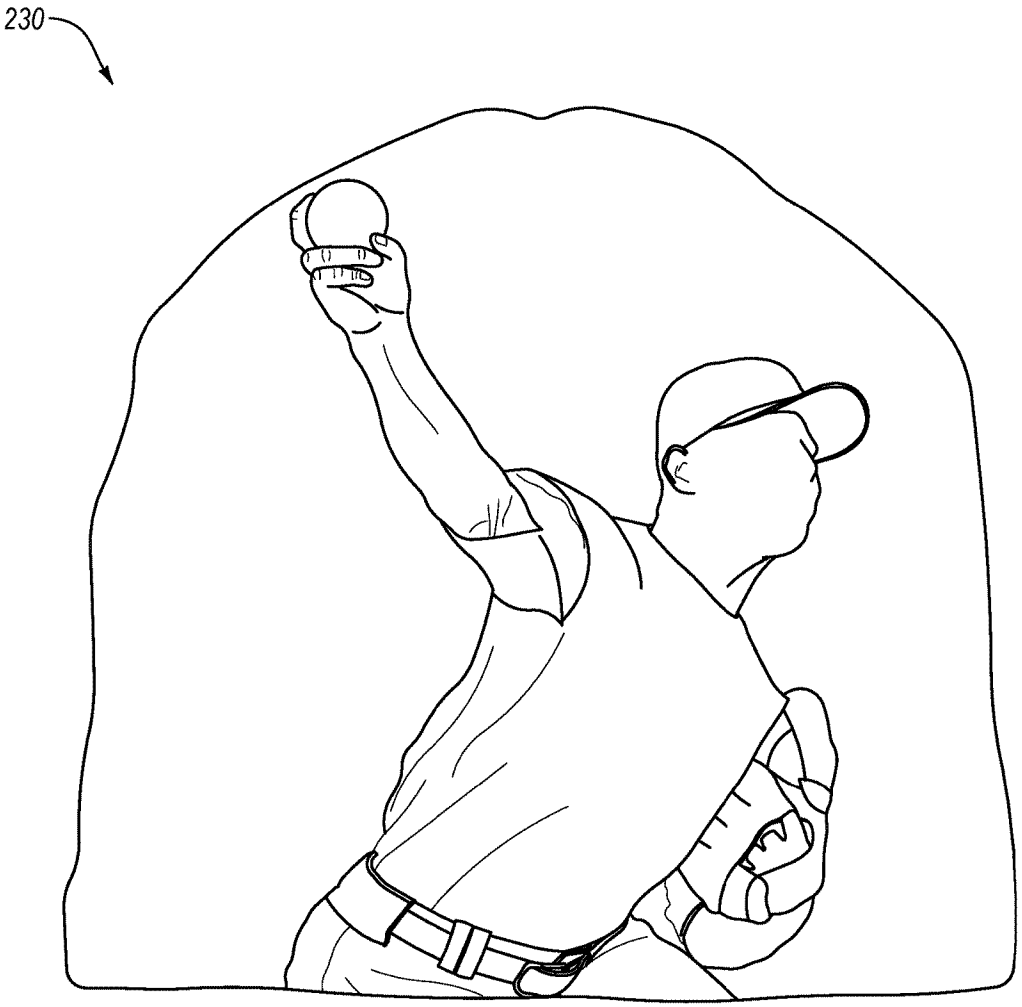
FIG. 2B is a graphic representation that illustrates an example headwear article with a sublimation printed image.

FIG. 2B is a graphic representation that illustrates an example headwear article 230 with sublimation printed images, arranged in accordance with at least some embodiments described in the present disclosure. The headwear article 230 may have an image printed thereon based on the description of FIG. 2A and may have the same or similar structure as the headwear article 100 of FIG. 1.

Figure 3:
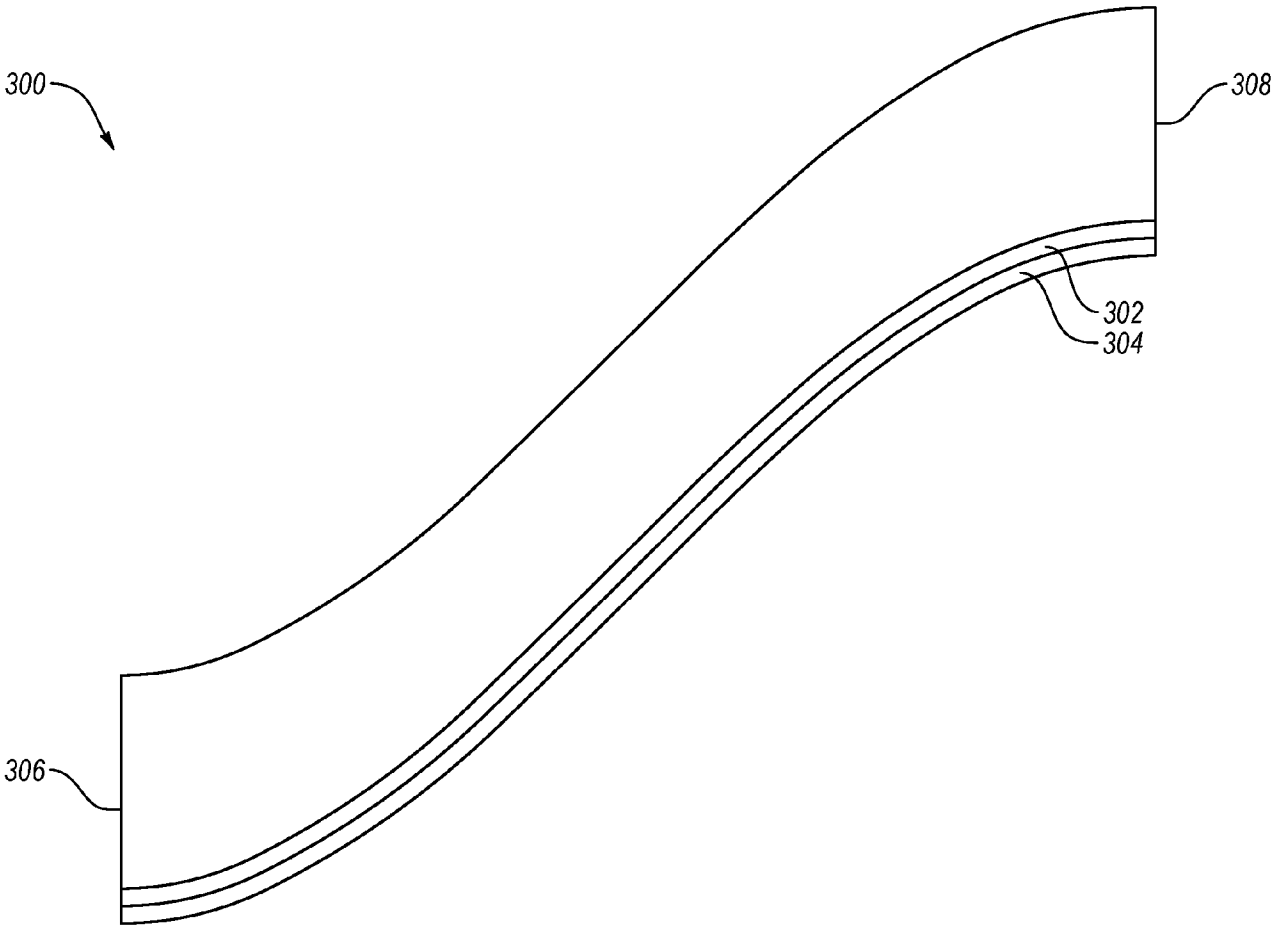
FIG. 3 illustrates an example neckwear article.

FIG. 3 illustrates an example neckwear article 300, arranged in accordance with at least some embodiments described in the present disclosure. Examples of the neckwear article 300 may include, but are not limited to, a scarf or a neck gator. In some embodiments, the neckwear article 300 may be a neckwear item used in cold weather for keeping warm. The neckwear article 300 may include one or more layers that may be combined together to form the neckwear article 300. For example, the neckwear article 300 may include a first layer 302 and a second layer 304 as illustrated in FIG. 3. In these and other embodiments, the neckwear article 300 may include one or more additional layers disposed between the first layer 302 and the second layer 304. In some embodiments, the first layer 302 and/or the second layer 304 may be stretchable, in which the second layer 304 may be more stretchable than the first layer 302.

The first layer 302 may be made of a first fabric that may be a polyester fabric similar to or the same as the polyester fabric described above with respect to the headwear article 100 of FIG. 1A. The second layer 304 may be attached to the first layer 302. For example, the second layer 304 may be sewn to, glued to, or compressed with the first layer 302. The second layer 304 may be made of a second fabric that may be a lining fabric similar to or the same as the lining fabric described above with respect to the headwear article 100 of FIG. 1A.

In some embodiments, the first layer 302 may be constructed as an outer shell or an outer layer of the neckwear article 300, and the second layer 304 may be constructed as an inner shell or an inner layer of the neckwear article 300. The outer shell (e.g., the first layer 302) of the neckwear article 300 may be printed with an image through sublimation printing. Alternatively or additionally, the first layer 302 may be constructed as an inner shell or an inner layer of the neckwear article 300, and the second layer 304 may be constructed as an outer shell or an outer layer of the neckwear article 300. The inner shell (e.g., the first layer 302) of the neckwear article 300 may be printed with an image through sublimation printing.

Alternatively or additionally, the second layer 304 may include the same or similar polyester fabric as the first layer 302 so that both of the first layer 302 and the second layer 304 may be printed with images through sublimation printing. For example, a first image may be printed on the first layer 302 through a first process of sublimation printing and a second image may be printed on the second layer 304 through a second process of sublimation printing. The first image and the second image may be the same image or different images such that the neckwear article 300 may have interchangeable images depending on whether the first layer 302 is on the outside or the second layer 304 is on the outside. In some of these embodiments, a third layer of lining material may be between the first layer 302 and the second layer 304 for extra warmth.

In some embodiments, the neckwear article 300 may not be printed with any image during production and may have a blank polyester fabric outer or inner shell. The blank polyester fabric outer or inner shell may be configured to accept sublimation printing in post-production.

In some embodiments, construction of the neckwear article 300 with the first layer 302 and the second layer 304 may enable the neckwear article 300 to satisfy an elastic attribute. For example, in some embodiments, an end 308 and an end 306 of the neckwear article 300 may be sewed together to form a neck gator. In such embodiments, the neckwear article 300 may have a target stretchability to allow for a wearer to pull the neckwear article over her head to fit around her neck. A target configuration of the neckwear article 300 may be that the neckwear article 300 is capable of stretching laterally by between 10% and 50%, or another suitable percentage relative to an unstretched status of the neckwear article 300.

In some embodiments, the first layer 302 may be sized to be larger than the second layer 304 to obtain the target stretchability. For example, in some embodiments, the target stretchability may be approximately 50% but the polyester fabric of the first layer 302 may have a stretchability of only approximately 40%. In these or other embodiments, the first layer 302 may be sized 10% larger than the second layer 304 such that the second layer 304 may be able to stretch approximately 50%. As such, the overall stretchability of the neckwear article 300 with respect to being able to fit over a wearer's head may be approximately 50%.

Figure 4A:
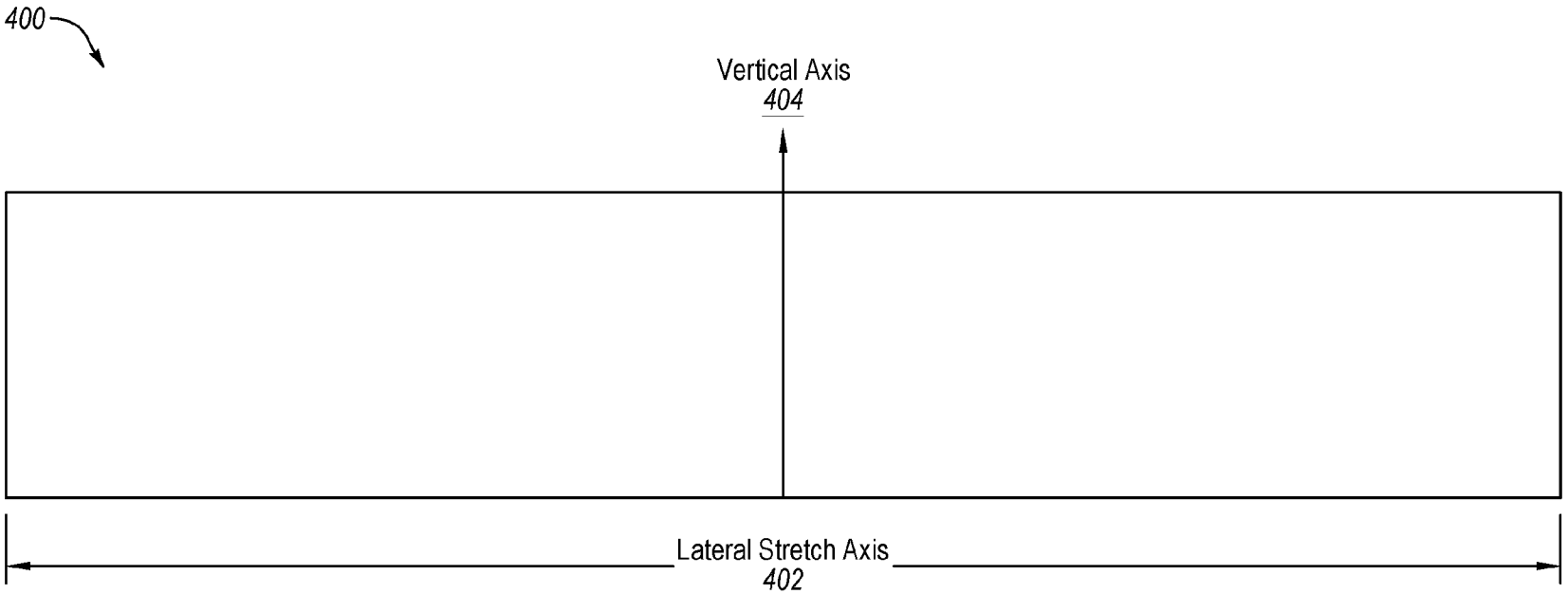
FIG. 4A is a graphic representation that illustrates an example neckwear article with a blank fabric panel.

FIG. 4A is a graphic representation that illustrates an example neckwear article 400 with a blank fabric panel, arranged in accordance with at least some embodiments described in the present disclosure. The neckwear article 400 may have the same or similar structure as the neckwear article 300 of FIG. 3. The blank fabric panel may be part of an inner shell or an outer shell of the neckwear article 400. The blank fabric panel may be printed with one or more images through sublimation printing.

In some embodiments, construction of the neckwear article 400 and the sublimation printing of the image on the neckwear article 400 may be performed based on a lateral stretch axis 402. The lateral stretch axis 402 may be referred to as an axis that is in parallel with a length of the neckwear article 400 such as illustrated in FIG. 4A. The neckwear article 400 may be configured such that it may be stretched laterally along the lateral stretch axis 402. A vertical axis 404 may be referred to an axis that is in parallel with a width of the neckwear article 400 such as illustrated in FIG. 4A. The vertical axis 404 may be orthogonal to the lateral stretch axis 402. In some embodiments, the neckwear article 400 may be symmetric with respect to the vertical axis 404. In some embodiments, the neckwear article 400 may be constructed in an analogous manner to that described above with respect to the neckwear article 300 such that the neckwear article 400 satisfies a target lateral stretchability.

In some embodiments, an image printed on the neckwear article 400 may be oriented such that a lateral stretch on the neckwear article 400 may correspond to a lateral stretch on the image rather than a vertical stretch on the image. For example, a top and a bottom of the image may be printed on the top part and the bottom part of the neckwear article 400 respectively so that a lateral stretch of the neckwear article 400 may correspondingly cause a lateral stretch of the image and a vertical stretch of the neckwear article 400 may correspondingly cause a vertical stretch of the image.

Figure 4B:
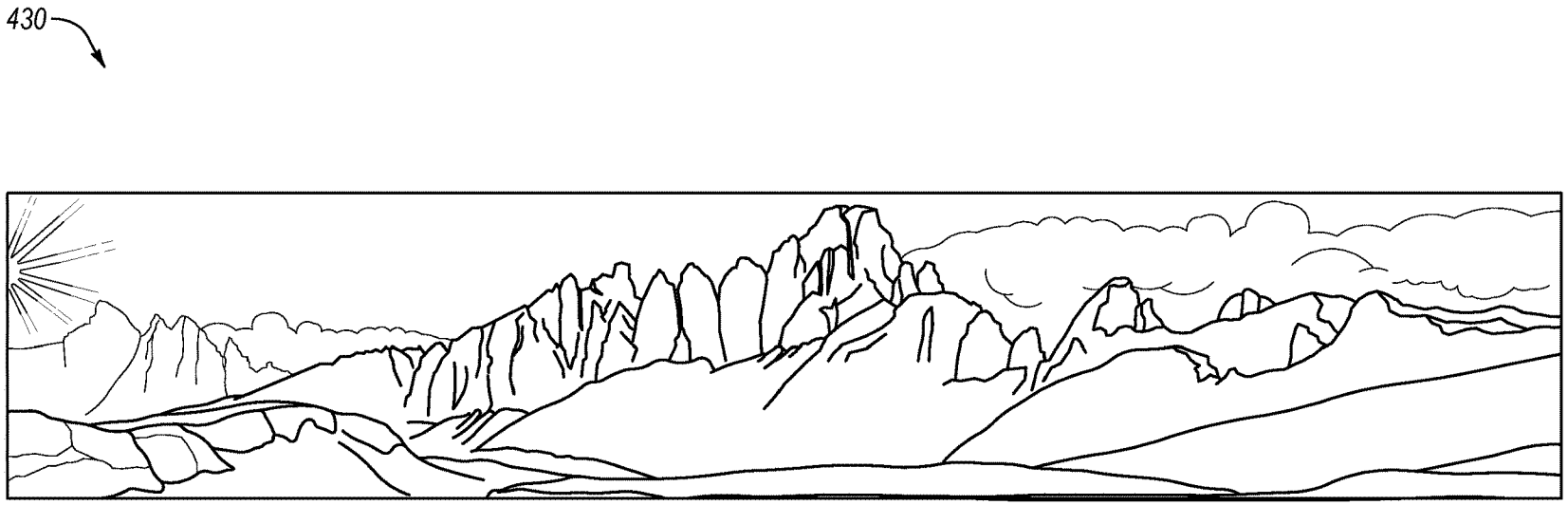
FIG. 4B is a graphic representation that illustrates an example neckwear article with a sublimation printed image.

FIG. 4B is a graphic representation that illustrates an example neckwear article 430 with sublimation printed images, arranged in accordance with at least some embodiments described in the present disclosure. The neckwear article 430 may have an image printed thereon based on the description of FIG. 4A and may have the same or similar structure as the neckwear article 300 of FIG. 3.

Figure 5:
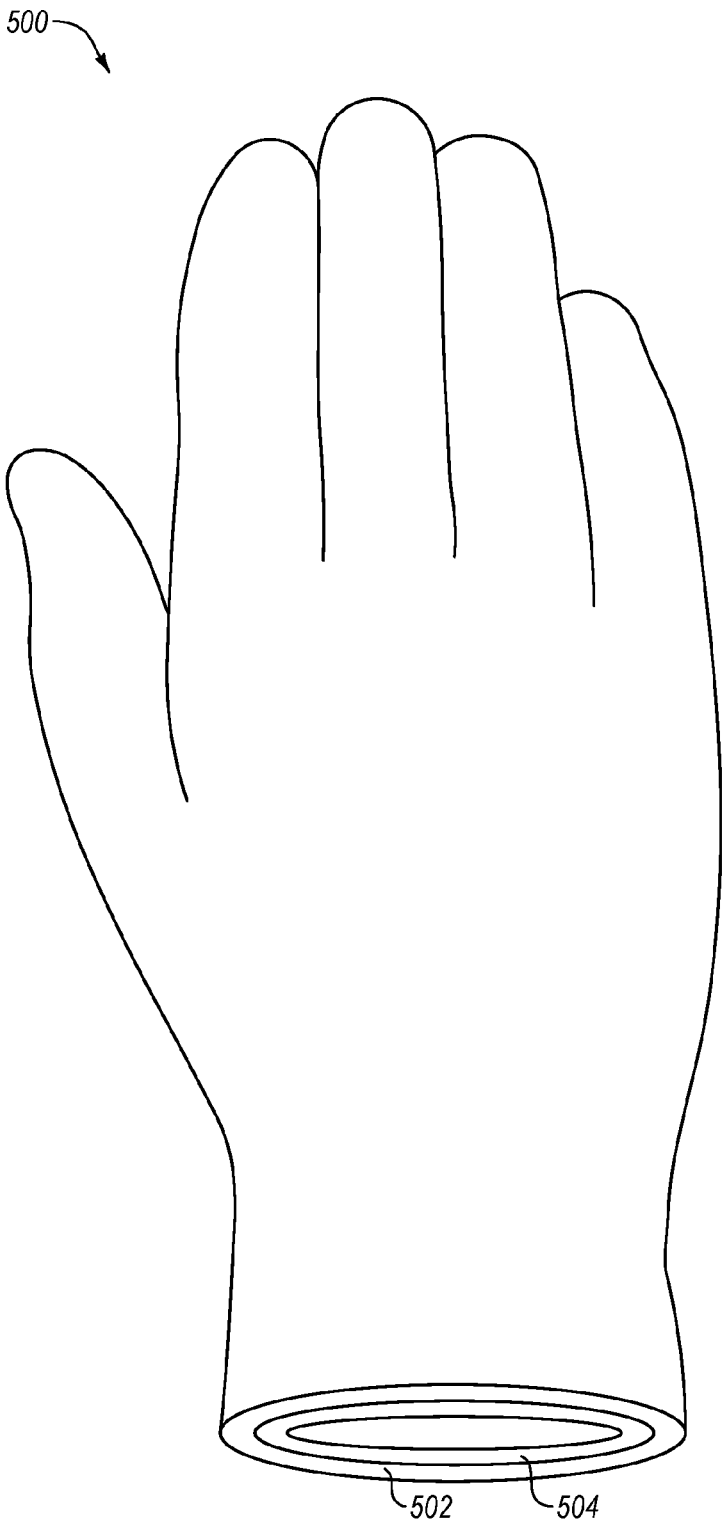
FIG. 5 illustrates an example handwear article.

FIG. 5 illustrates an example handwear article 500, arranged in accordance with at least some embodiments described in the present disclosure. Examples of the handwear article 500 may include, but are not limited to a glove. In some embodiments, the handwear article 500 may be a glove used in cold weather for keeping warm. The handwear article 500 may include one or more layers that may be combined together to form the handwear article 500. For example, the handwear article 500 may include a first layer 502 and a second layer 504 as illustrated in FIG. 5. In these and other embodiments, the handwear article 500 may include one or more additional layers disposed between the first layer 502 and the second layer 504. In some embodiments, the first layer 502 and/or the second layer 504 may be stretchable, in which the second layer 504 may be more stretchable than the first layer 502.

The first layer 502 may be made of a first fabric that may be a polyester fabric similar to or the same as the polyester fabric described above with respect to the headwear article 100 of FIG. 1A. The second layer 504 may be attached to the first layer 502. For example, the second layer 504 may be sewn to, glued to, or compressed with the first layer 502. The second layer 504 may be made of a second fabric that may be a lining fabric similar to or the same as the lining fabric described above with respect to the headwear article 100 of FIG. 1A.

In some embodiments, the first layer 502 may be constructed as an outer shell or an outer layer of the handwear article 500, and the second layer 504 may be constructed as an inner shell or an inner layer of the handwear article 500. The outer shell (e.g., the first layer 502) of the handwear article 500 may be printed with an image through sublimation printing. Alternatively or additionally, the first layer 502 may be constructed as an inner shell or an inner layer of the handwear article 500, and the second layer 504 may be constructed as an outer shell or an outer layer of the handwear article 500. The inner shell (e.g., the first layer 502) of the handwear article 500 may be printed with an image through sublimation printing.

Alternatively or additionally, the second layer 504 may include the same or similar polyester fabric as the first layer 502 so that both of the first layer 502 and the second layer 504 may be printed with images through sublimation printing. For example, a first image may be printed on the first layer 502 through a first process of sublimation printing and a second image may be printed on the second layer 504 through a second process of sublimation printing. The first image and the second image may be the same image or different images such that the handwear article 500 may have interchangeable images depending on whether the first layer 502 is on the outside or the second layer 504 is on the outside. In some of these embodiments, a third layer of lining material may be between the first layer 502 and the second layer 504 for extra warmth. In some embodiments, the handwear article 500 may not be printed with any image during production and may have a blank polyester fabric outer or inner shell. The blank polyester fabric outer or inner shell may be configured to accept sublimation printing in post-production.

In some embodiments, construction of the handwear article 500 with the first layer 502 and the second layer 504 may enable the handwear article 500 to satisfy an elastic attribute. For example, the handwear article 500 may have a target stretchability to allow for a wearer to pull the handwear article 500 over her hand and to allow the handwear article 500 to form around her hand. A target configuration of the handwear article 500 may be that the handwear article 500 is capable of stretching laterally by between 10% and 50%, or another suitable percentage relative to an unstretched status of the handwear article 500.

In some embodiments, the first layer 502 may be sized to be larger than the second layer 504 to obtain the target stretchability. For example, in some embodiments, the target stretchability may be approximately 50% but the polyester fabric of the first layer 502 may have a stretchability of only approximately 40%. In these or other embodiments, the first layer 502 may be sized 10% larger than the second layer 504 such that the second layer 504 may be able to stretch approximately 50%. As such, the overall stretchability of the handwear article 500 with respect to being able to fit over a wearer's hand may be approximately 50%.

Figure 6A:
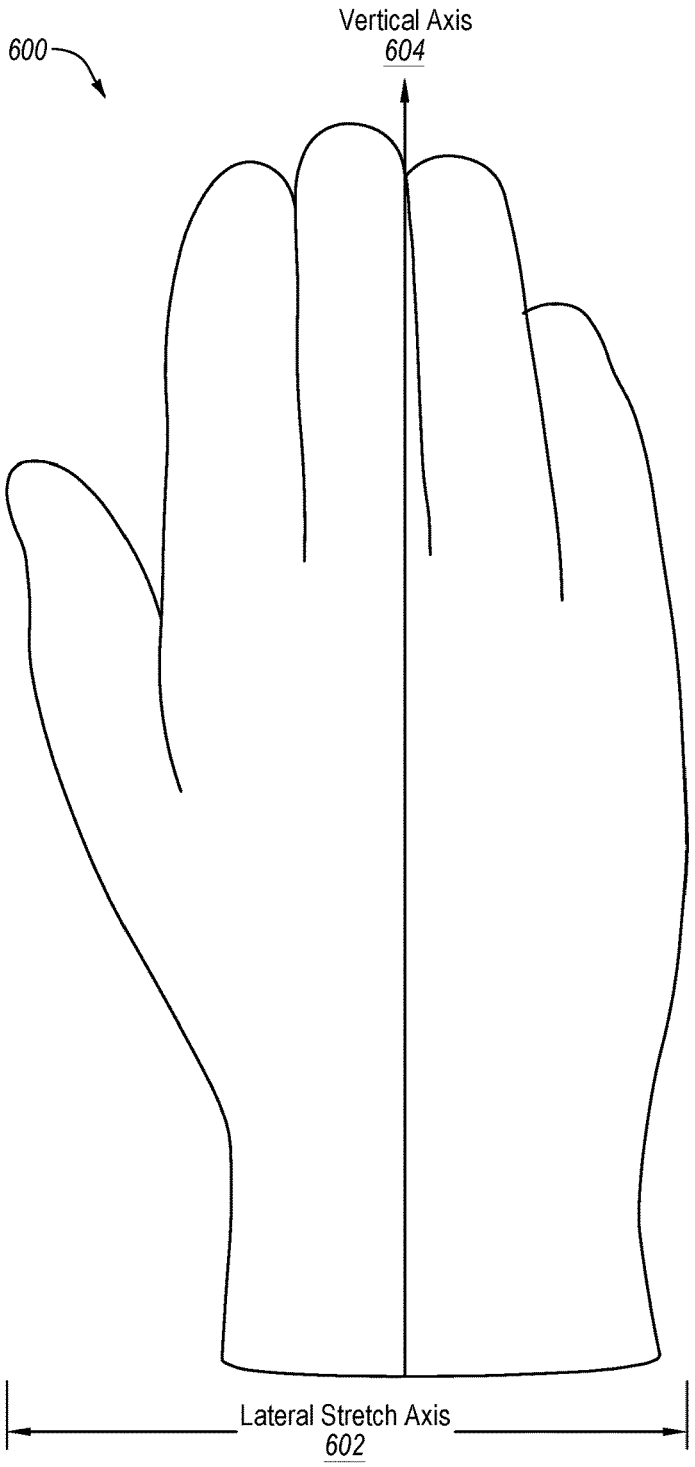
FIG. 6A is a graphic representation that illustrates an example handwear article with a blank fabric panel.

FIG. 6A is a graphic representation that illustrates an example footwear article 600 with a blank fabric panel, arranged in accordance with at least some embodiments described in the present disclosure. The handwear article 600 may have the same or similar structure as the handwear article 500 of FIG. 5. The blank fabric panel may be part of an inner shell or an outer shell of the handwear article 600. The blank fabric panel may be printed with one or more images through sublimation printing. In these or other embodiments, the fabric panel may be printed before being cut to make the finger holes.

In some embodiments, construction of the handwear article 600 and the sublimation printing of the image on the handwear article 600 may be performed based on a lateral stretch axis 602. The lateral stretch axis 602 may be referred to as an axis that is in parallel with a bottom portion of the handwear article 600 configured to receive a wearer's hand, such as illustrated in FIG. 6A. The handwear article 600 may be configured such that it may be stretched laterally along the lateral stretch axis 602. A vertical axis 604 may be referred to an axis that is orthogonal to the lateral stretch axis 602, such as illustrated in FIG. 6A. As mentioned above, in some embodiments, the handwear article 600 may be constructed in an analogous manner to that described above with respect to the handwear article 500 such that the handwear article 600 satisfies a target lateral stretchability. The target lateral stretchability may also refer to a target lateral stretchability of the fingers of the handwear article 600. In these or other embodiments, similar principles may be applied to obtain a target vertical stretchability about the vertical axis 604.

In some embodiments, an image printed on the handwear article 600 may be oriented such that a lateral stretch on the handwear article 600 may correspond to a lateral stretch on the image rather than a vertical stretch on the image. For example, a top and a bottom of the image may be printed on the top part and the bottom part of the handwear article 600 respectively so that a lateral stretch of the handwear article 600 may correspondingly cause a lateral stretch of the image and a vertical stretch of the handwear article 600 may correspondingly cause a vertical stretch of the image.

Figure 6B:
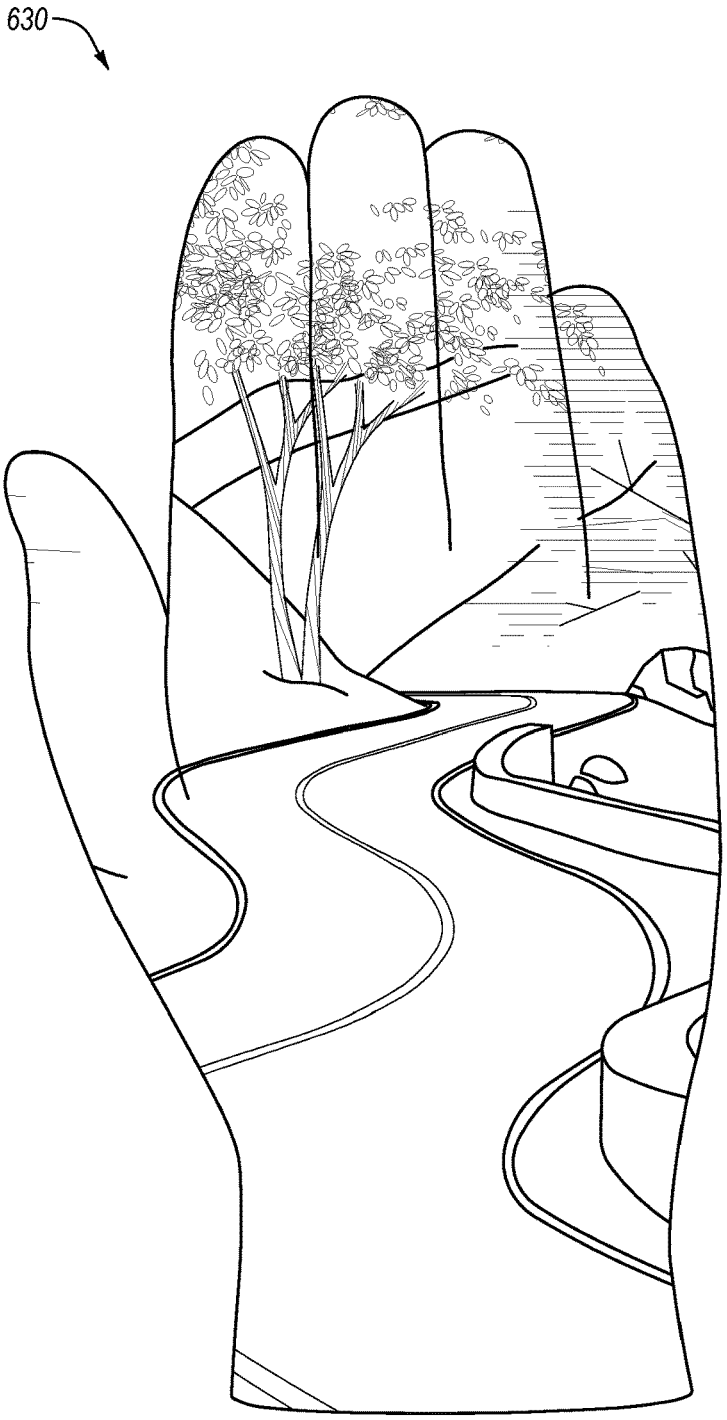
FIG. 6B is a graphic representation that illustrates an example handwear article with a sublimation printed image.

FIG. 6B is a graphic representation that illustrates an example handwear article 630 with sublimation printed images, arranged in accordance with at least some embodiments described in the present disclosure. The handwear article 630 may have an image printed thereon based on the description of FIG. 6A and may have the same or similar structure as the handwear article 500 of FIG. 5.

Figure 7:
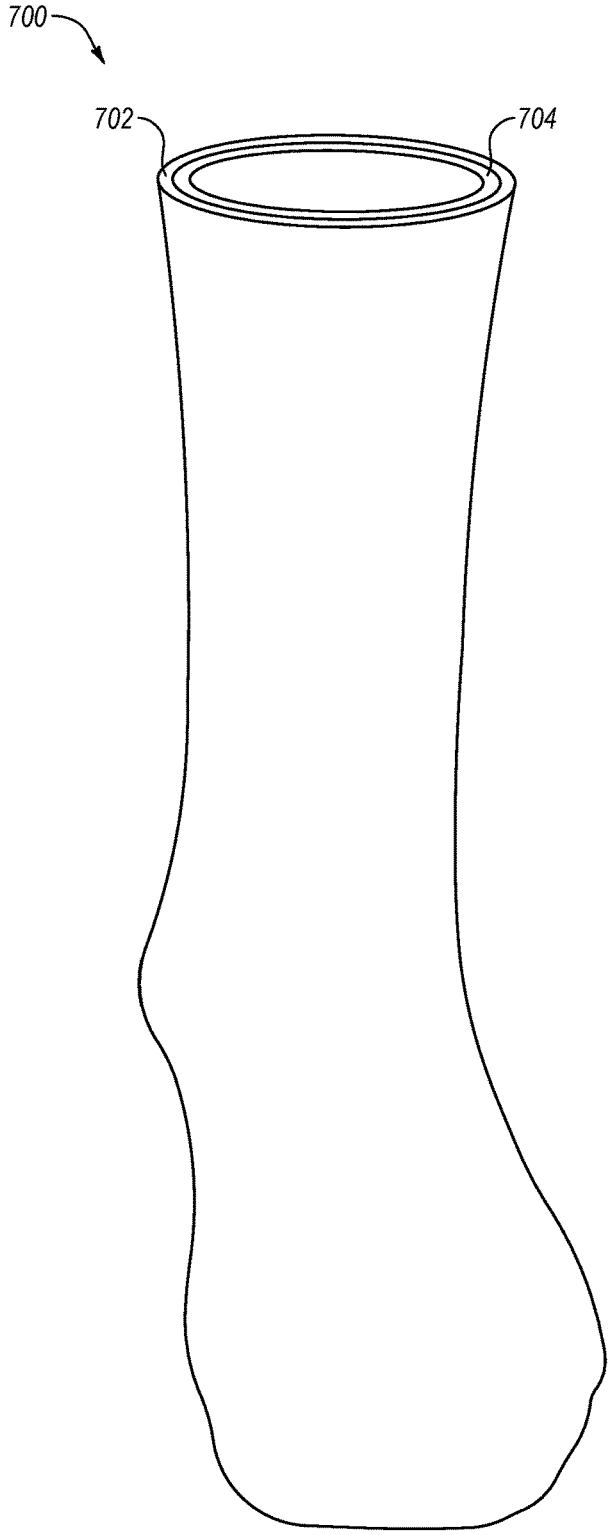
FIG. 7 illustrates an example footwear article.

FIG. 7 illustrates an example footwear article 700, arranged in accordance with at least some embodiments described in the present disclosure. Examples of the footwear article 700 may include, but are not limited to a sock. In some embodiments, the footwear article 700 may be a sock used in cold weather for keeping warm. The footwear article 700 may include one or more layers that may be combined together to form the footwear article 700. For example, the footwear article 700 may include a first layer 702 and a second layer 704 as illustrated in FIG. 7. In these and other embodiments, the footwear article 700 may include one or more additional layers disposed between the first layer 702 and the second layer 704. In some embodiments, the first layer 702 and/or the second layer 704 may be stretchable, in which the second layer 704 may be more stretchable than the first layer 702.

The first layer 702 may be made of a first fabric that may be a polyester fabric similar to or the same as the polyester fabric described above with respect to the headwear article 100 of FIG. 1A. The second layer 704 may be attached to the first layer 702. For example, the second layer 704 may be sewn to, glued to, or compressed with the first layer 702. The second layer 704 may be made of a second fabric that may be a lining fabric similar to or the same as the lining fabric described above with respect to the headwear article 100 of FIG. 1A.

In some embodiments, the first layer 702 may be constructed as an outer shell or an outer layer of the footwear article 700, and the second layer 704 may be constructed as an inner shell or an inner layer of the footwear article 700. The outer shell (e.g., the first layer 702) of the footwear article 700 may be printed with an image through sublimation printing. Alternatively or additionally, the first layer 702 may be constructed as an inner shell or an inner layer of the footwear article 700, and the second layer 704 may be constructed as an outer shell or an outer layer of the footwear article 700. The inner shell (e.g., the first layer 702) of the footwear article 700 may be printed with an image through sublimation printing.

Alternatively or additionally, the second layer 704 may include the same or similar polyester fabric as the first layer 702 so that both of the first layer 702 and the second layer 704 may be printed with images through sublimation printing. For example, a first image may be printed on the first layer 702 through a first process of sublimation printing and a second image may be printed on the second layer 704 through a second process of sublimation printing. The first image and the second image may be the same image or different images such that the footwear article 700 may have interchangeable images depending on whether the first layer 702 is on the outside or the second layer 704 is on the outside. In some of these embodiments, a third layer of lining material may be between the first layer 702 and the second layer 704 for extra warmth. In some embodiments, the footwear article 700 may not be printed with any image during production and may have a blank polyester fabric outer or inner shell. The blank polyester fabric outer or inner shell may be configured to accept sublimation printing in post-production.

In some embodiments, construction of the footwear article 700 with the first layer 702 and the second layer 704 may enable the footwear article 700 to satisfy an elastic attribute. For example, the footwear article 700 may have a target stretchability to allow for a wearer to pull the footwear article 700 over her foot and to allow the footwear article 700 to form around her foot. A target configuration of the footwear article 700 may be that the footwear article 700 is capable of stretching laterally by between 10% and 50%, or another suitable percentage relative to an unstretched status of the footwear article 700.

In some embodiments, the first layer 702 may be sized to be larger than the second layer 704 to obtain the target stretchability. For example, in some embodiments, the target stretchability may be approximately 50% but the polyester fabric of the first layer 702 may have a stretchability of only approximately 40%. In these or other embodiments, the first layer 702 may be sized 10% larger than the second layer 704 such that the second layer 704 may be able to stretch approximately 50%. As such, the overall stretchability of the footwear article 700 with respect to being able to fit over a wearer's foot may be approximately 50%.

Figure 8A:
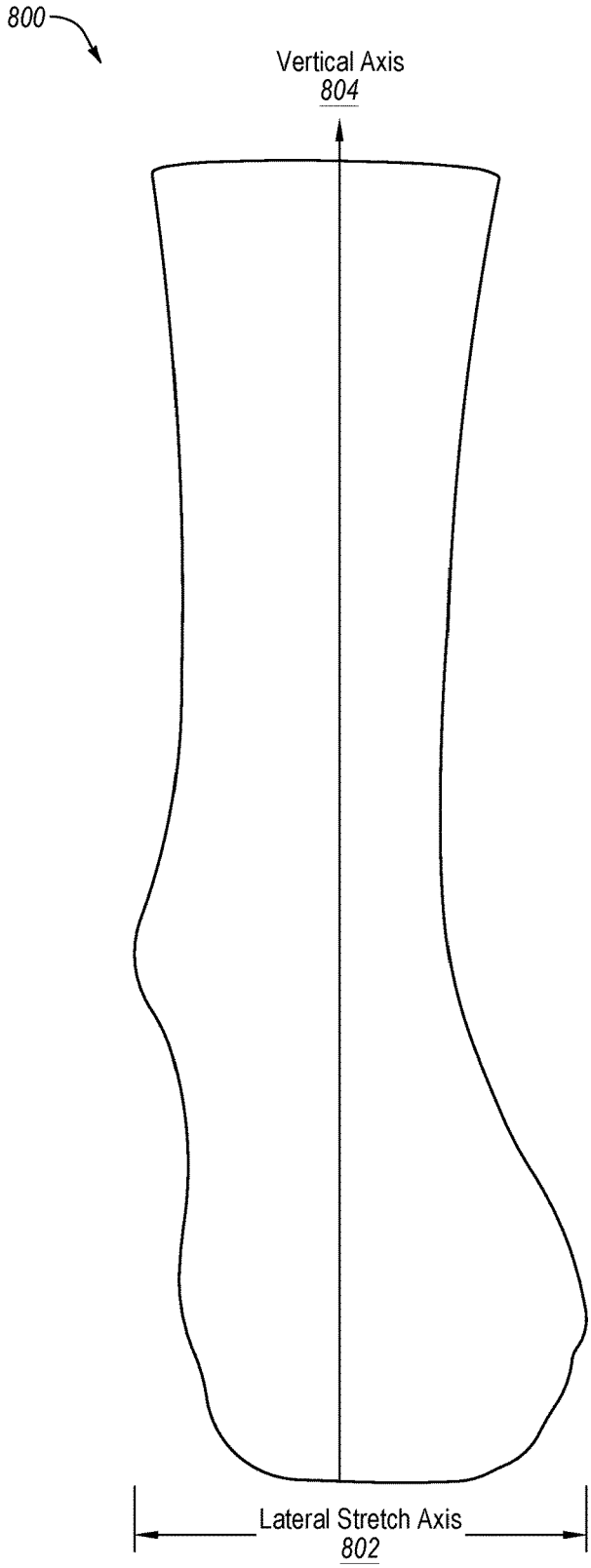
FIG. 8A is a graphic representation that illustrates an example footwear article with a blank fabric panel.

FIG. 8A is a graphic representation that illustrates an example footwear article with a blank fabric panel, arranged in accordance with at least some embodiments described in the present disclosure. The footwear article 800 may have the same or similar structure as the footwear article 700 of FIG. 7. The blank fabric panel may be part of an inner shell or an outer shell of the footwear article 800. The blank fabric panel may be printed with one or more images through sublimation printing.

In some embodiments, construction of the footwear article 800 and the sublimation printing of the image on the footwear article 800 may be performed based on a lateral stretch axis 802. The lateral stretch axis 802 may be referred to as an axis that is in parallel with a receiving of the footwear article 800 configured to receive a wearer's foot, such as illustrated in FIG. 8A. The footwear article 800 may be configured such that it may be stretched laterally along the lateral stretch axis 802. A vertical axis 804 may be referred to an axis that is orthogonal to the lateral stretch axis 802, such as illustrated in FIG. 8A. As mentioned above, in some embodiments, the footwear article 800 may be constructed in an analogous manner to that described above with respect to the footwear article 700 such that the footwear article 800 satisfies a target lateral stretchability. In these or other embodiments, similar principles may be applied to obtain a target vertical stretchability about the vertical axis 804.

In some embodiments, an image printed on the footwear article 800 may be oriented such that a lateral stretch on the footwear article 800 may correspond to a lateral stretch on the image rather than a vertical stretch on the image. For example, a top and a bottom of the image may be printed on the top part and the bottom part of the footwear article 800 respectively so that a lateral stretch of the footwear article 800 may correspondingly cause a lateral stretch of the image and a vertical stretch of the footwear article 800 may correspondingly cause a vertical stretch of the image.

Figure 8B:
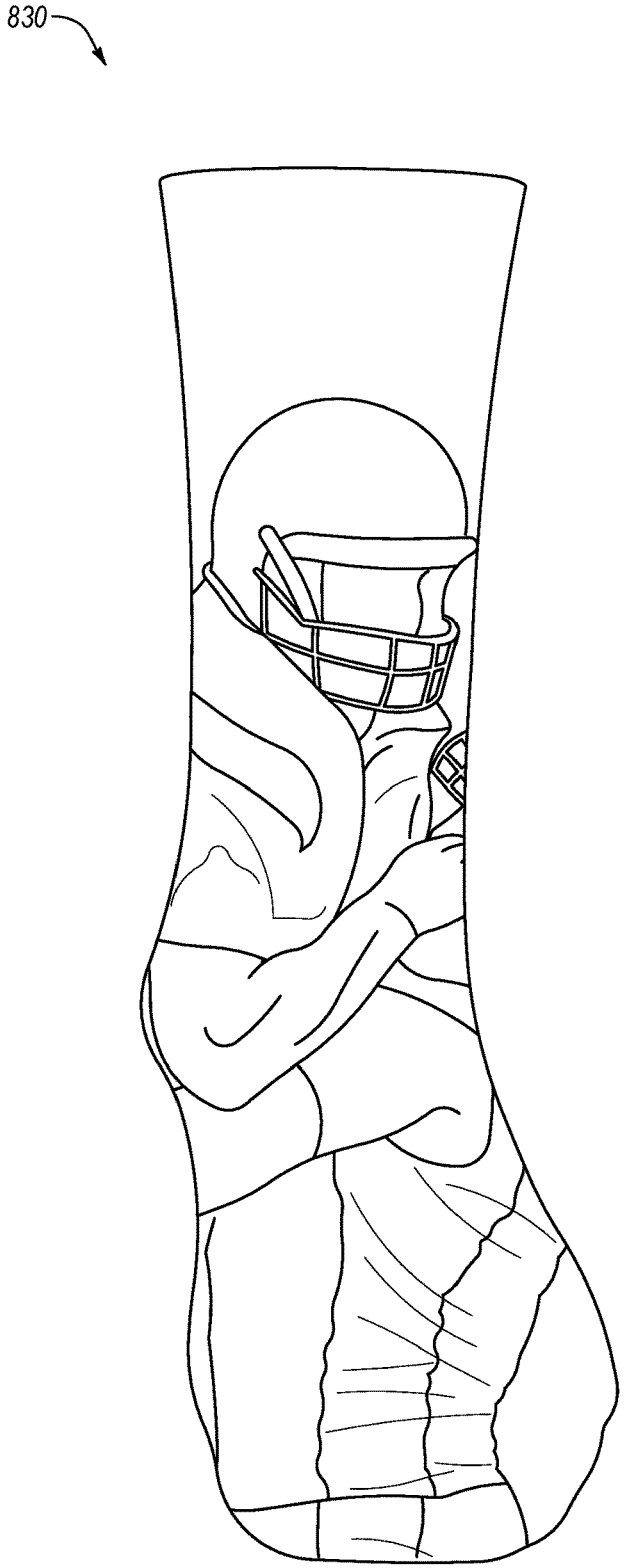
FIG. 8B is a graphic representation that illustrates an example footwear article with a sublimation printed image.

FIG. 8B is a graphic representation that illustrates an example footwear article 830 with sublimation printed images, arranged in accordance with at least some embodiments described in the present disclosure. The footwear article 830 may have an image printed thereon based on the description of FIG. 8A and may have the same or similar structure as the footwear article 700 of FIG. 7.

FIGS. 1A-8B give specific examples of sublimation printed articles of clothing. However, the same properties described above may be used to produce other sublimation printed articles of clothing that may include a first layer and a second layer. Further, the pictures, dimensions, shapes, etc. illustrated in the present disclosure are merely examples and are not meant to be limiting.

FIG. 9 is a graphic representation that illustrates an example dye sublimation heat transfer printing process 900 (referred to hereinafter as the "sublimation printing process 900), arranged in accordance with at least some embodiments described in the present disclosure. Initially, one or more images may be printed on a coated heat-resistant transfer paper 902 as a reverse image of a final design using dye sublimation inks. The dye sublimation inks may be a pigment suspended in a liquid solvent such as water or any other suitable liquid solvent. The reverse image may be transferred onto polyester fabric 904 (such as described above) in a heat press that may operate at a temperature around 180° C. to 210° C. For example, a heat source 906 with a temperature around 180° C. to 210° C. may be pressed on the coated heat-resistant paper 902 so that under high temperature and pressure the dye in the coated heat-resistant paper 902 may turn into a gas, permeate the polyester fabric 904 and then solidify into the fabric's fibers. The polyester fabric 904 may be permanently dyed so that it may be washed without damaging the quality of the image. With the dye sublimation heat transfer imprinting process, it is possible to reproduce intricate designs on articles of clothing with accuracy. Additionally, use of the polyester fabric described may allow for much higher resolution images than other fabrics that may be used.

Figure 10:
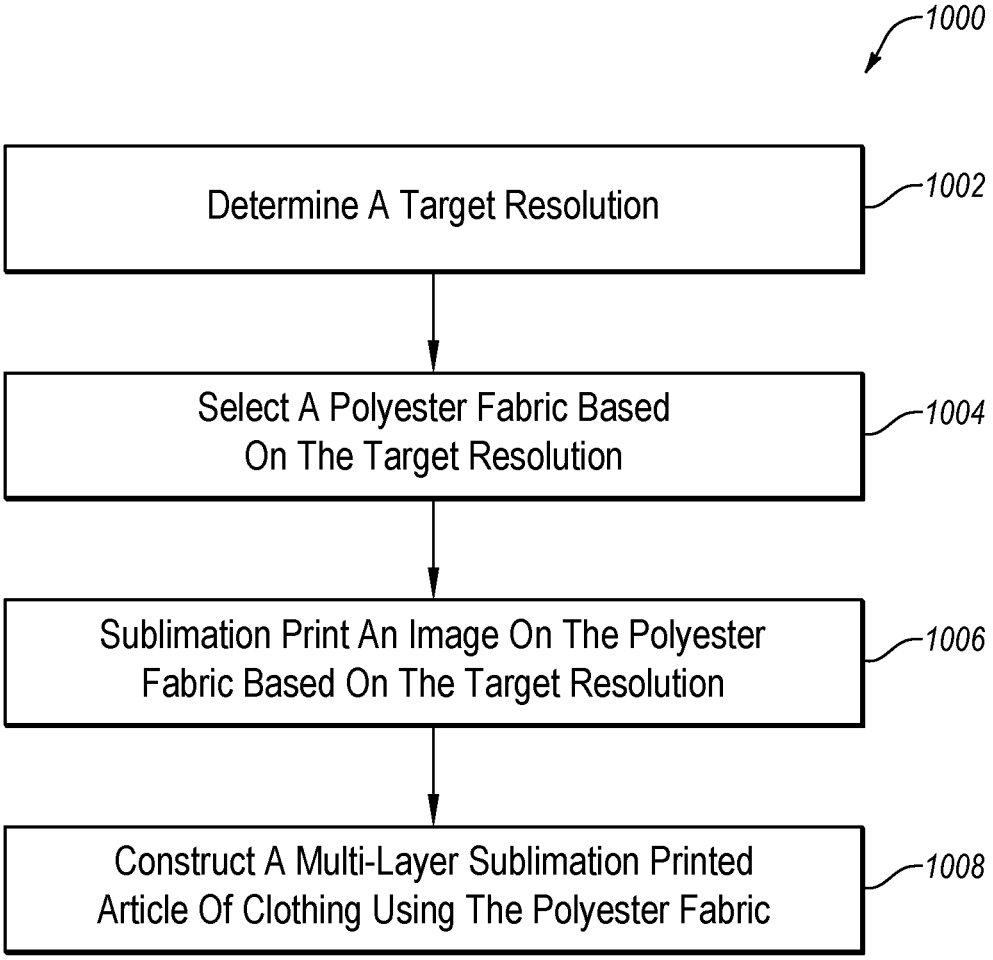
FIG. 10 is an example flow diagram of a method of constructing an article of clothing with a sublimation printed image.

FIG. 10 shows an example flow diagram of a method 1000 of constructing an article of clothing with a sublimation printed image, arranged in accordance with at least some embodiments described herein. The method 1000 may be used to construct the headwear articles, neckwear articles, handwear articles, or footwear articles described above, or any other applicable article of clothing. Although illustrated as discrete blocks, various blocks may be divided into additional blocks, combined into fewer blocks, or eliminated, depending on the desired implementation.

The method 1000 may begin at block 1002, in which a target resolution may be determined for a sublimation printed article of clothing. At block 1004 a polyester fabric may be selected based on the target resolution. In particular, a polyester fabric with properties that allow for obtaining the target resolution may be selected. By way of example, a 100% polyester fabric with a thread count of at least 130 threads per square inch, a weft knit weave pattern, and a bird's eye mesh texture may be selected. In some embodiments, one or more of the above-cited example properties may be changed, if they allow for the target resolution.

At block 1006, an image may be sublimation printed on the selected polyester fabric. In some embodiments, the sublimation printing may be according to the description given above with respect to FIG. 9. At block 1008 a multi-layer sublimation printed article of clothing may be constructed using the polyester fabric and a lining fabric.

By way of example, a headwear article such as headwear articles 100, 200, and 230 described above may be constructed at block 1008 using one or more principles described above with respect to FIGS. 1A-2B. As another example, a neckwear article such as neckwear articles 300, 400, and 430 described above may be constructed at block 1008 using one or more principles described above with respect to FIGS. 3-4B. As another example, a handwear article such as handwear articles 500, 600, and 630 described above may be constructed at block 1008 using one or more principles described above with respect to FIGS. 5-6B. As another example, a footwear article such as footwear articles 700, 800, and 830 described above may be constructed at block 1008 using one or more principles described above with respect to FIGS. 7-8B.

For this and other processes and methods disclosed with respect to FIG. 10, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

All examples and conditional language recited herein are intended for pedagogical objects to aid the reader in understanding the present disclosure and the concepts contributed by the inventor to furthering the art, and are to be construed as being without limitation to such specifically recited examples and conditions. Although embodiments of the present disclosure have been described in detail, it should be understood that the various changes, substitutions, and alterations could be made hereto without departing from the spirit and scope of the present disclosure.

The present disclosure is not to be limited in terms of the particular embodiments described herein, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that the present disclosure is not limited to particular methods, reagents, compounds, compositions, or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

The present disclosure may be embodied in other specific forms without departing from its spirit or essential characteristics. The described embodiments are to be considered in all respects only as illustrative and not restrictive. The scope of the present disclosure is, therefore, indicated by the appended claims rather than by the foregoing description. All changes which come within the meaning and range of equivalency of the claims are to be embraced within their scope.

What is claimed is:

1. A headwear article comprising:

a first layer made of a polyester fabric having the following properties a thread count of at least 130 threads per square inch, a weft knit weave pattern, a stretchability of less than 50%, and a bird's eye mesh texture, the polyester fabric including a dye sublimation printed image with a resolution that is at least 200 dots per inch, the dye sublimation printed image being oriented to stretch laterally with a lateral stretch of the polyester fabric; and a second layer attached to the first layer, the second layer including lining fabric configured to stretch laterally with the first layer;

wherein the headwear article has a first stretchability at a bottom of the headwear article and has a second stretchability at a top portion of the headwear article, wherein the second stretchability is less than the first stretchability and the top portion of the headwear article includes a plurality of triangular portions sewn together such that the second stretchability is based on the plurality of triangular portions.

2. The headwear article of claim 1, wherein the lining fabric in the second layer includes at least one of acrylic knit, cotton knit, wool knit, polar fleece, and polyester stretchable fabric.

3. The headwear article of claim 1, wherein the first layer is an outer layer and the second layer is an inner layer.

4. The headwear article of claim 1, wherein the resolution is between 300 and 1400 dots per inch.

5. The headwear article of claim 1, wherein the first stretchability is approximately between 10% and 30% and wherein the second stretchability is approximately between 30% and 60%.

6. A method of constructing a headwear article, the method comprising:

determining a target resolution of a sublimation printed image of a headwear article;

selecting a polyester fabric for reception of the sublimation printed image based on one or more properties of the polyester fabric and based on how the one or more properties relate to the target resolution;

printing, based on the target resolution, an image on a coated heat-resistant transfer paper with dye sublimation inks;

applying a heat press on the coated heat-resistant transfer paper and the polyester fabric to transfer the image to the polyester fabric;

constructing the headwear article using the polyester fabric as a first layer and a layer of lining fabric as a second layer, wherein constructing the headwear article includes constructing the headwear article to have a first stretchability at a bottom portion of the headwear article and to have a second stretchability at a top portion of the headwear article; and cutting the polyester fabric during the constructing step to produce a plurality of triangular portions along a portion of the polyester fabric that corresponds to the top portion of the headwear article and sewing the plurality of triangular portions together to enclose the top portion of the headwear article, and the first stretchability being greater than the second stretchability.

7. The method of claim 6, wherein the target resolution is greater than 200 dots per inch.

8. The method of claim 6, wherein the one or more properties include one or more of the following: thread count, texture, stretchability, and weave pattern.

9. The method of claim 6, wherein the one or more properties include a thread count of at least 150 threads per square inch.

10. The method of claim 6, wherein the one or more properties include a bird's eye mesh texture.

11. The method of claim 6, wherein the one or more properties include a weft knit weave pattern.

12. The method of claim 6, wherein the one or more properties include a stretchability of less than 50%.

13. The method of claim 6, further comprising orienting the coated heat-resistant transfer paper on the polyester fabric in a manner that a lateral stretch of the polyester fabric is lateral with respect to an orientation of the image.

14. The method of claim 6, further comprising selecting the lining fabric based on its insulative properties.

15. The method of claim 6, further comprising selecting the lining fabric to include at least one of acrylic knit, cotton knit, wool knit, polar fleece, and polyester stretchable fabric.

16. The method of claim 6, wherein the first stretchability is approximately between 10% and 30% and wherein the second stretchability is approximately between 30% and 60%.

* * * * *